US008807919B2

(12) United States Patent
Kato et al.

(10) Patent No.: US 8,807,919 B2
(45) Date of Patent: Aug. 19, 2014

(54) COUNTER-ROTATING AXIAL FLOW FAN

(75) Inventors: Chisachi Kato, Tokyo (JP); Atsushi Yamaguchi, Kanagawa (JP); Akira Ueda, Kanagawa (JP); Kazuhiro Nitta, Kanagawa (JP); Akihiro Otsuka, Sr., Kanagawa (JP); Tadashi Katsui, Kanagawa (JP); Masahiro Suzuki, Kanagawa (JP); Yoshihiko Aizawa, Nagano (JP); Honami Oosawa, Nagano (JP)

(73) Assignees: The University of Tokyo, Tokyo (JP); Fujitsu Limited, Kawasaki-Shi (JP); Sanyo Denki Co., Ltd., Tokyo (JP)

( * ) Notice: Subject to any disclaimer, the term of this patent is extended or adjusted under 35 U.S.C. 154(b) by 893 days.

(21) Appl. No.: 12/967,196

(22) Filed: Dec. 14, 2010

(65) Prior Publication Data

US 2011/0142614 A1 Jun. 16, 2011

(30) Foreign Application Priority Data

Dec. 14, 2009 (JP) ..... 2009-283288

(51) Int. Cl.

| | |
|---|---|
| ***F04D 19/02*** | (2006.01) |
| ***F04D 29/40*** | (2006.01) |
| ***F04D 19/00*** | (2006.01) |
| ***F04D 29/52*** | (2006.01) |
| ***F04D 29/66*** | (2006.01) |
| ***F04D 29/54*** | (2006.01) |

(52) U.S. Cl.

CPC ..... *F04D 29/663* (2013.01); *F04D 19/002* (2013.01); *F04D 29/526* (2013.01); *F04D 19/024* (2013.01); *F04D 29/542* (2013.01); *F04D 29/667* (2013.01)

USPC ..... 415/68; 415/186; 415/199.5; 416/128

(58) Field of Classification Search

USPC ..... 361/687, 690, 694, 695; 416/120, 124, 416/125, 128

See application file for complete search history.

(56) References Cited

U.S. PATENT DOCUMENTS

| | | | | |
|---|---|---|---|---|
| 4,152,094 | A | 5/1979 | Honda et al. | |
| 4,844,692 | A * | 7/1989 | Minkkinen et al. | 415/208.1 |

(Continued)

FOREIGN PATENT DOCUMENTS

| | | |
|---|---|---|
| DE | 2242988 | 3/1974 |
| JP | 54-169808 | 5/1953 |

(Continued)

OTHER PUBLICATIONS

Print-out of bibliographic data for JP54169808U from Dialog.*

*Primary Examiner* — Edward Look
*Assistant Examiner* — Christopher R Legendre
(74) *Attorney, Agent, or Firm* — Rankin, Hill & Clark LLP

(57) ABSTRACT

A counter-rotating axial flow fan with reduced noise at the target operating point achieved without modifying a front impeller, a rear impeller, or a middle stationary portion is provided. An annular rib including a projecting surface for generating turbulent flow is formed on an inner wall portion of a casing at a position off from the middle stationary portion to a side of the rear impeller, the projecting surface extending radially inwardly of the inner wall portion and extending continuously in the circumferential direction of the inner wall portion. A fluid striking the projecting surface for generating turbulent flow is partially disturbed to form a turbulent flow before entering an area in which the rear impeller is provided. The turbulent flow suppresses flow separation of a fluid flowing along the surfaces of rear blades of the rear impeller from the surfaces of the rear blades.

1 Claim, 10 Drawing Sheets

(56) References Cited

U.S. PATENT DOCUMENTS

| | | | | |
|---|---|---|---|---|
| 7,445,423 | B2 | 11/2008 | Ishihara et al. | |
| 7,942,627 | B2 * | 5/2011 | Jin | 415/66 |
| 7,997,859 | B2 * | 8/2011 | Li et al. | 415/175 |
| 8,226,350 | B2 * | 7/2012 | Hayashigaito et al. | 415/66 |
| 8,348,593 | B2 * | 1/2013 | Yoshida | 415/66 |
| 2002/0076323 | A1 * | 6/2002 | Fujinaka | 415/220 |
| 2008/0260517 | A1 * | 10/2008 | Hayashigaito et al. | 415/68 |
| 2011/0142612 | A1 * | 6/2011 | Kato et al. | 415/206 |
| 2011/0142614 | A1 * | 6/2011 | Kato et al. | 415/220 |
| 2012/0243985 | A1 * | 9/2012 | Nitta et al. | 415/220 |
| 2013/0051997 | A1 * | 2/2013 | Uchiyama et al. | 415/193 |

FOREIGN PATENT DOCUMENTS

| | | | |
|---|---|---|---|
| JP | 49-76303 | | 9/1972 |
| JP | 52-055006 | | 5/1977 |
| JP | 57-073805 | | 5/1982 |
| JP | 57-116200 | | 7/1982 |
| JP | 08-159099 | | 6/1996 |
| JP | 11264396 | A * | 9/1999 |
| JP | 2000-027798 | | 1/2000 |
| JP | 2003-278696 | | 10/2003 |
| JP | 4128194 | | 7/2008 |
| JP | 2008-208799 | | 9/2008 |
| JP | 2008-267201 | | 11/2008 |

* cited by examiner

Fig.3A

| TYPE OF FAN (CONTENT OF ANTI-NOISE MEASURES) | 0.5 [$m^3$/min], 370 [Pa] |
|---|---|
| | SOUND PRESSURE LEVEL [dB (A)] |
| (a) NO PROJECTION PROVIDED | 57.5 |
| (b) 1-mm PROJECTION PROVIDED BETWEEN REAR BLADES AND STATIONARY BLADES | 59.8 |
| (c) 0.6-mm PROJECTION PROVIDED BETWEEN REAR BLADES AND STATIONARY BLADES | 58.0 |
| (d) 0.4-mm PROJECTION PROVIDED BETWEEN REAR BLADES AND STATIONARY BLADES | 58.0 |
| (e) 0.2-mm PROJECTION PROVIDED BETWEEN REAR BLADES AND STATIONARY BLADES | 57.6 |

Fig. 4A

| TYPE OF FAN (CONTENT OF ANTI-NOISE MEASURES) | 0.45 [$m^3$/min], 390 [Pa] |
|---|---|
| | SOUND PRESSURE LEVEL [dB (A)] |
| (a′) NO PROJECTION PROVIDED | 58.6 |
| (b′) 1-mm PROJECTION PROVIDED BETWEEN REAR BLADES AND STATIONARY BLADES | 60.6 |
| (c′) 0.6-mm PROJECTION PROVIDED BETWEEN REAR BLADES AND STATIONARY BLADES | 59.4 |
| (d′) 0.4-mm PROJECTION PROVIDED BETWEEN REAR BLADES AND STATIONARY BLADES | 58.8 |
| (e′) 0.2-mm PROJECTION PROVIDED BETWEEN REAR BLADES AND STATIONARY BLADES | 58.3 |

COUNTER-ROTATING AXIAL FLOW FAN

TECHNICAL FIELD

The present invention relates to a counter-rotating axial flow fan with a front impeller and a rear impeller configured to rotate in opposite directions to each other.

BACKGROUND ART

Japanese Patent No. 4128194 discloses a counter-rotating axial flow fan which includes a casing including an air channel having a suction port on one side in an axial direction and a discharge port on the other side in the axial direction, a front impeller including a plurality of front blades and configured to rotate in the air channel, a rear impeller including a plurality of rear blades and configured to rotate in the air channel, and a middle stationary portion formed by a plurality of stationary blades or struts disposed to be stationary between the front impeller and the rear impeller in the air channel.

In such conventional counter-rotating axial flow fan, the front impeller, the rear impeller, and the middle stationary portion are elaborately shaped to reduce noise. It has been found that noise at the target operating point can be reduced by optimizing the design of the front impeller, the rear impeller, and the middle stationary portion. In practice, however, a counter-rotating axial flow fan may be operated at an operating point (desired target operating point) more or less deviated from the target operating point that has been set in the initial design, which consequently leads to increased noise.

SUMMARY OF THE INVENTION

An object of the present invention is to provide a counter-rotating axial flow fan capable of reducing noise at the target operating point, which may be achieved without modifying a front impeller, a rear impeller, or a middle stationary portion thereof.

A counter-rotating axial flow fan, of which improvements are aimed at by the present invention, includes: a casing including an air channel having a suction port on one side in an axial direction and a discharge port on the other side in the axial direct ion; a front impeller including a plurality of front blades and configured to rotate in the air channel; a rear impeller including a plurality of rear blades and configured to rotate in the air channel; and a middle stationary portion formed by a plurality of stationary blades or a plurality of struts disposed to be stationary between the front impeller and the rear impeller in the air channel.

In the counter-rotating axial flow fan according to the present invention, one or more projecting surfaces for generating turbulent flow are formed on an inner wall portion of the casing surrounding the air channel at a position off from the middle stationary portion to the side of the rear impeller, the one or more projecting surfaces extending radially inwardly of the inner wall portion and extending continuously or at intervals in a circumferential direction of the inner wall portion. The one or more projecting surfaces for generating turbulent flow may be located at a position in proximity to the middle stationary portion. The one or more projecting surfaces for generating turbulent flow may be located at a position away from the middle stationary portion to the side of the rear impeller. It has been verified that a counter-rotating axial flow fan having formed one or more appropriate projecting surfaces for generating turbulent flow may reduce noise, compared to noise produced by a counter-rotating axial flow fan having formed no projecting surfaces for generating turbulent flow, when the two counter-rotating axial flow fans are operated at the same operating point. That is, it has been verified that noise may be reduced by providing one or more projecting surfaces for generating turbulent flow without modifying the front impeller, the rear impeller, or the middle stationary portion. Although the reason for such reduction has not been sufficiently clarified yet, the inventors infer that a fluid discharged from the front impeller and striking the one or more projecting surfaces for generating turbulent flow is partially disturbed, thereby forming a turbulent flow before entering an area in which the rear impeller is provided, and that the thus formed turbulent flow applies a force for suppressing flow separation of the fluid from the surfaces of the rear blades to the flow of a fluid flowing along the surfaces of the rear blades of the rear impeller and then discharged out. The turbulent flow presumably contributes to noise reduction in this manner. Noise can be more or less reduced if one or more projecting surfaces for generating turbulent flow are formed so as to have an appropriate size for an operating point. Thus, although the size of the one or more projecting surfaces for generating turbulent flow may not be readily defined, the one or more projecting surfaces for generating turbulent flow may arbitrarily be shaped and sized as long as occurrence of flow separation of a fluid from the surfaces of the rear blades can be prevented or restrained at the target operating point.

In order to form the one or more projecting surfaces for generating turbulent flow, one or more ribs may preferably be formed on the inner wall portion of the casing at a position off from the middle stationary portion to the side of the rear impeller, the ribs extending radially inwardly of the inner wall portion and extending continuously or at intervals in the circumferential direction. The one or more ribs may be formed such that one or more surfaces of the one or more ribs facing the front impeller form the one or more projecting surfaces for generating turbulent flow. Since such ribs can be formed easily during formation of the casing, anti-noise measures can be implemented at a low cost.

The one or more ribs may extend toward the discharge port to generally face the rear impeller in a radial direction. With such long ribs provided, not only the casing can be reinforced, but also the distance between the rear blades of the rear impeller and the inner wall portion of the casing can be reduced, thereby enhancing the static pressure. Alternatively, the one or more ribs may extend toward the discharge port not to face the rear impeller in a radial direction.

BRIEF DESCRIPTION OF THE DRAWINGS

FIGS. 3A and 3B respectively show the noise characteristics and the static pressure—air flow characteristics of an existing counter-rotating axial flow fan and four types of the existing counter-rotating axial flow fans having one or more projecting surfaces for generating turbulent flow formed according to the embodiments of the present invention. The existing fan is appropriately designed to be operated at a target operating point with an air flow of 0.5 $m^3$/min and a static pressure of 370 Pa. Alt the fans are operated at the target operating point.

FIGS. 4A and 4B respectively show the noise characteristics and the static pressure—air flow characteristics of an existing counter-rotating axial flow fan and four types of the existing counter-rotating axial flow fans having the one or more projecting surfaces for generating turbulent flow formed according to the embodiments of the present invention. All the fans are operated at a changed target operating point with an air flow of 0.45 $m^3$/min and a static pressure of 390 Pa. The existing fan is appropriately designed to operate at a target operating point with an air flow of 0.5 $m^3$/min and a static pressure of 370 Pa.

DESCRIPTION OF THE PREFERRED EMBODIMENTS

Figure 1:
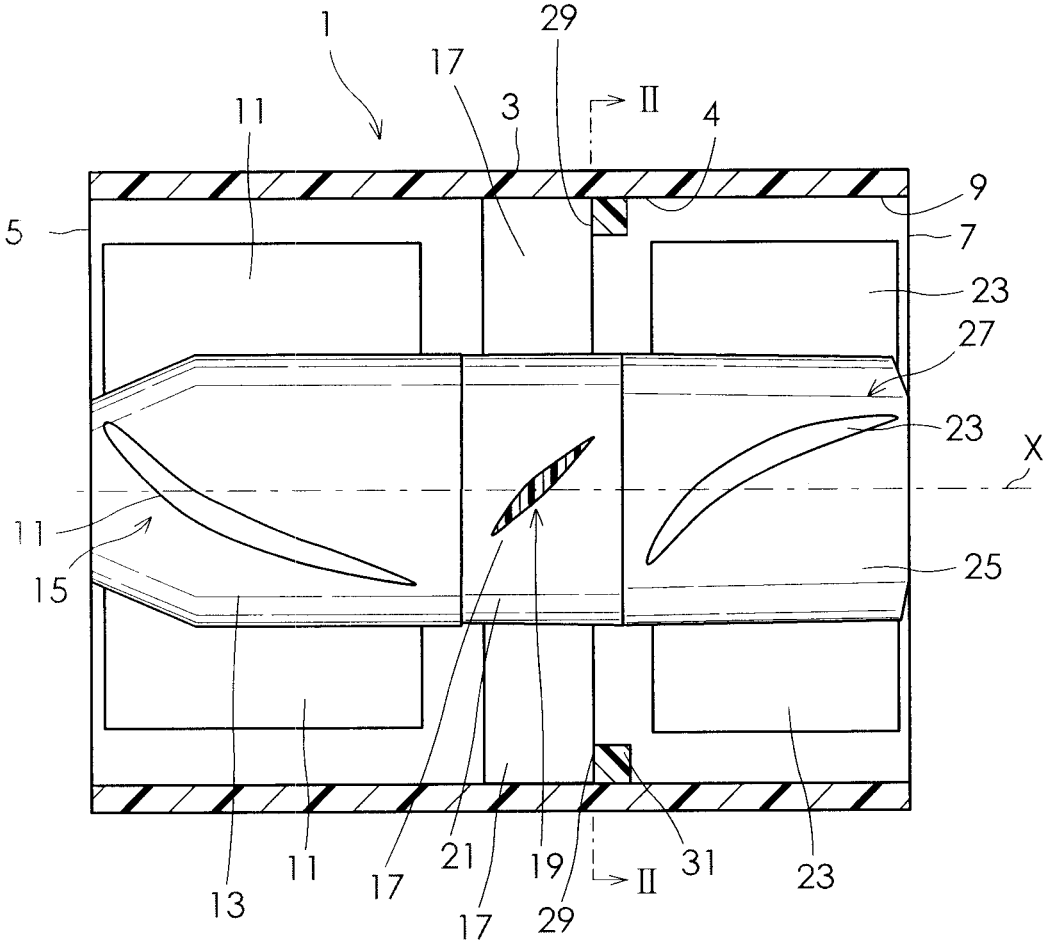
FIG. 1 schematically shows the configuration of a counter-rotating axial flow fan according to an embodiment.
Figure 2:
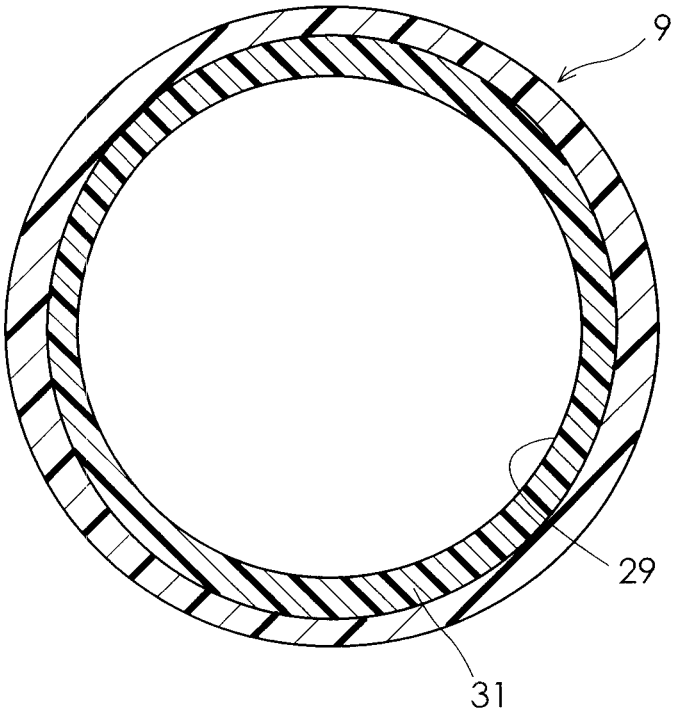
FIG. 2 is a cross-sectional view taken along line II-II of FIG. 1.

A counter-rotating axial flow fan according to an embodiment of the present invention will be described below with reference to the drawings. FIG. 1 schematically shows the configuration of a counter-rotating axial flow fan 1 according to the embodiment, in which only a cylindrical casing 3 is shown in cross section. FIG. 2 is a cross-sectional view taken along line II-II of FIG. 1. The casing 3 includes an air channel 9 having a suction port 5 on one side in an axial direction of an axial line X and a discharge port 7 on the other side in the axial direction. The casing 3 may be formed by assembling two divided casings which define a dividing plane at a center in the axial direction of the casing 3 formed of the two divided casings assembled together. The dividing plane extends in the direction orthogonal to the axial line X. A front impeller 15 comprises a hub 13 and a plurality of front blades 11 fixed to the hub 13, and is disposed inside the air channel 9 at the side of the suction port 5. The plurality of front blades 11 are disposed at equidistant intervals in the circumferential direction of the hub 13. An end of each of the front blades 11 is fixed to an outer peripheral portion of the hub 13. A rotor of a front motor serving as a drive source for the front impeller 15 is fixed inside the hub 13. A middle stationary portion 19 includes a plurality of stationary blades 17, and is disposed in a center portion of the air channel 9. One end of each of the plurality of stationary blades 17 is fixed to an outer peripheral portion of a center body 21, and the other end of each of the stationary blades 17 is fixed to an inner wall portion 4 of the casing 3. A stator of the front motor mentioned above is fixed to the center body 21. The plurality of stationary blades 17 are disposed on an outer peripheral portion of the center body 21 at equidistant intervals in the circumferential direction around the axial line X. A rear impeller 27 comprises a plurality of rear blades 23 and a hub 25, and is disposed inside the air channel 9 at the side of the discharge port 7. The plurality of rear blades 23 are disposed at equidistant intervals in the circumferential direction of the hub 25. An end of each of the rear blades 23 is fixed to an outer peripheral portion of the hub 25. A rotor of a rear motor serving as a drive source for the rear impeller 27 is fixed inside the hub 25. A stator of the rear motor is fixed to the center body 21 of the middle stationary portion 19.

In the embodiment, an annular rib 31 including a projecting surface 29 for generating turbulent flow is formed on the inner wall portion 4 of the casing 3 at a position in proximity to the middle stationary portion and between the middle stationary portion 19 and the rear impeller 27, the projecting surface 29 extending radially inwardly of the inner wall portion 4 and extending continuously in the circumferential direction of the inner wall portion 4. In the embodiment, a fluid discharged from the front impeller 15 and striking the projecting surface 29 for generating turbulent flow is partially disturbed, thereby forming a turbulent flow before entering an area in which the rear impeller 27 is provided. It is considered that the turbulent flow applies a force for suppressing or restraining flow separation of the fluid from the surfaces of the rear blades 23 to the fluid flow flowing along the surfaces of the rear blades 23 of the rear impeller 27 and then discharged out. It has been experimentally verified that noise is reduced when the projecting surface 29 for generating turbulent flow are formed appropriately for the target operating point.

Figure 3B:
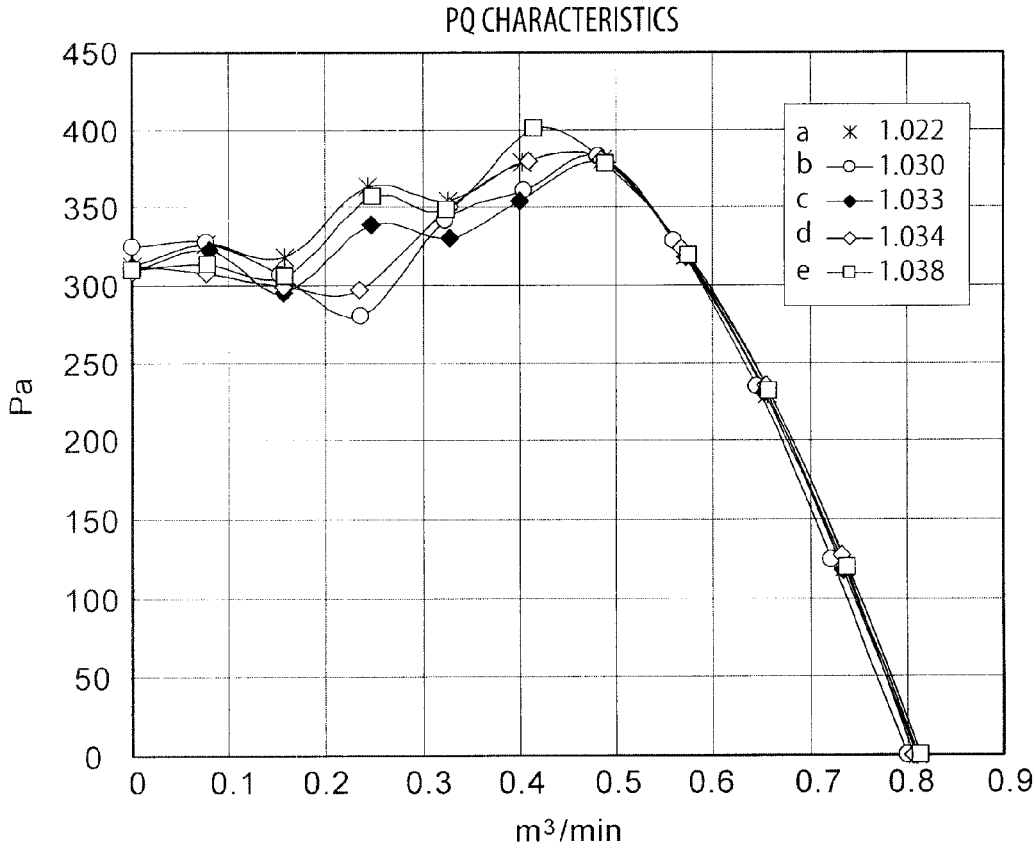
Figure 4B:
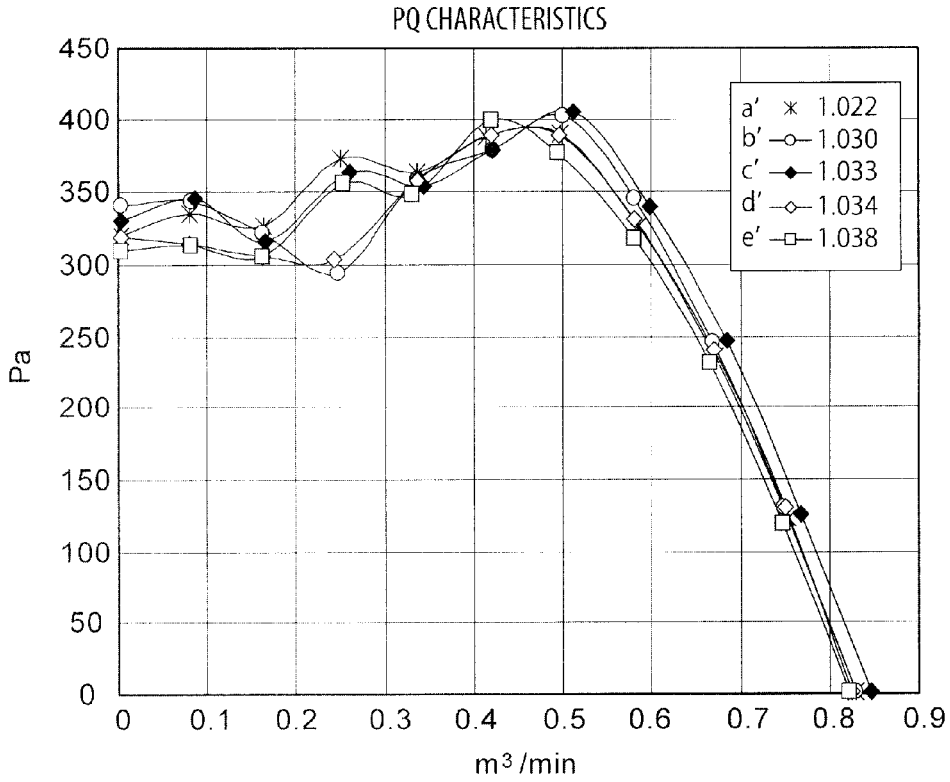

FIGS. 3A and 3B respectively show the noise characteristics and the static pressure—air flow characteristics of an existing counter-rotating axial flow fan [having no projecting surfaces formed therein: (a)] and four types of the existing fans with four types of projecting surfaces for generating turbulent flow (b) to (e) formed according to the embodiments of the present invention. The existing fan is appropriately designed to be operated at a target operating point with an air flow of 0.5 $m^3$/min and a static pressure of 370 Pa. In FIG. 3A, the expression "1-mm projection" means that the projecting surface for generating turbulent flow projects radially by 1 mm. As shown in FIG. 3A, providing a projecting surface for generating turbulent flow may increase noise in a counter-rotating axial flow fan having a front impeller, a rear impeller, and a middle stationary portion which are designed such that noise of a predetermined sound pressure level may be produced at the target operating point. As shown in FIG. 3B, the target operating point is not changed. FIGS. 4A and 4B respectively show the noise characteristics and the static pressure—air flow characteristics of an existing counter-rotating axial flow fan [having no projecting surfaces therein: (a)] and four types of the existing fans with the four types (b') to (e') of one or more projecting surfaces for generating turbulent flow formed according to the embodiments of the present invention. All the fans are operated at a changed target operating point with an air flow of 0.45 $m^3$/min and a static pressure of 390 Pa. The existing fan is appropriately designed to be operated at a target operating point with an air flow of 0.5 $m^3$/min and a static pressure of 370 Pa. As shown in FIG. 4A, when the fan is operated at the changed target operating point, providing a projecting surface for generating turbulent flow extending radially by 0.2 mm reduces noise compared to when no projecting surface for generating turbulent flow is provided [having no projecting surfaces formed therein: (a')]. Providing a projecting surface for generating turbulent flow that is longer than 0.2 mm increases noise. This proves that noise may be reduced by providing a projecting surface for generating turbulent flow without modifying the front impeller, the rear impeller, or the middle stationary portion in some cases. In other words, it is proved that noise increases when the target operating point is changed, but that the front impeller, the rear impeller, and the middle stationary portion, which have been designed to be operated at a specific target operating point, are left unchanged, but in some cases such noise may be decreased by providing a projecting surface for generating turbulent flow.

An optimum value of the size of the projecting surface 29 for generating turbulent flow is determined according to how much or to what extent the target operating point is changed when the fan is operated without changing the respective numbers, shapes, and sizes of the front blades, the rear blades, and the stationary blades of the fan which has been designed to be operated at a specific target operating point. Therefore, although the size of the projecting surface 29 for generating turbulent flow cannot readily be determined, preferable shape and size of the projecting surface 29 for generating turbulent flow may be obtained through simulation in the design stage. Accordingly, the projecting surface 29 for generating turbulent flow may arbitrarily be shaped and sized as long as occurrence of flow separation of a fluid flow from the surfaces of the rear blades 23 can be prevented or restrained at the target operating point.

Figure 5:
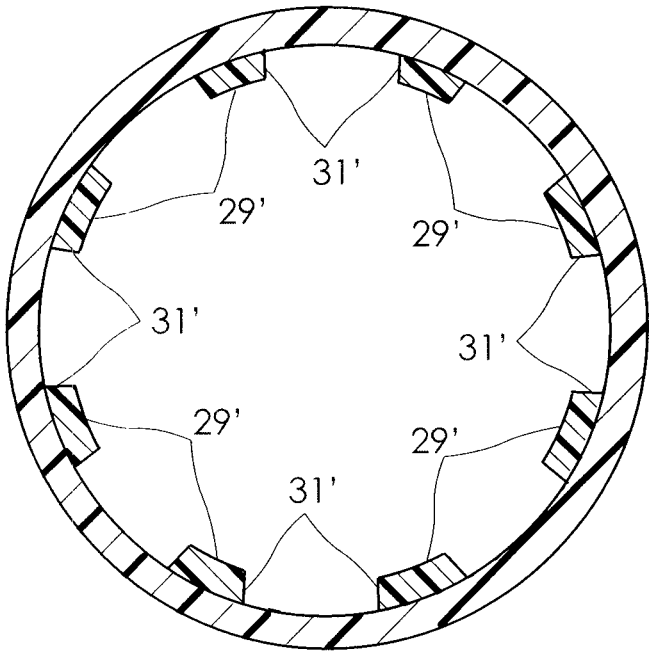
FIG. 5 is a cross-sectional view showing an example in which projecting surfaces for generating turbulent flow are formed at intervals in the circumferential direction.

The projecting surface 29 for generating turbulent flow is not necessarily continuous in the circumferential direction as in the above embodiment. Rather, as shown in FIG. 5, one or more ribs 31' may be formed on the inner wall portion 4 of the casing 3 at a position off from the middle stationary portion 19 to the side of the rear impeller 27. The ribs 31' extend radially inwardly of the inner wall portion 4 and extend at intervals in the circumferential direction of the inner wall portion 4, thereby forming one or more projecting surfaces 29' for generating turbulent flow at intervals in the circumferential direction. In this case, the interval between the projecting surfaces 29' for generating turbulent flow may be appropriately determined according to the structure of the counter-rotating axial flow fan to be provided.

Figure 6:
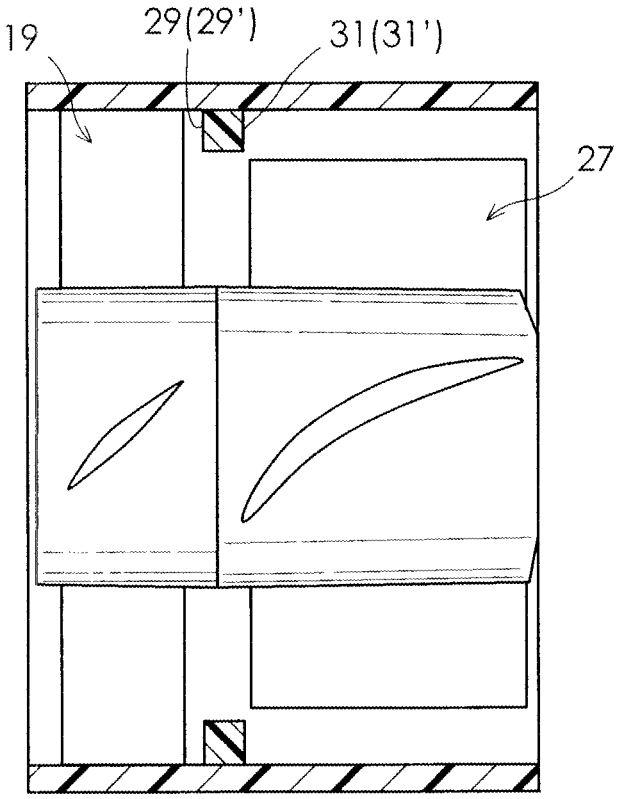
FIG. 6 is a cross-sectional view showing an essential portion of another embodiment of the present invention.
Figure 7:
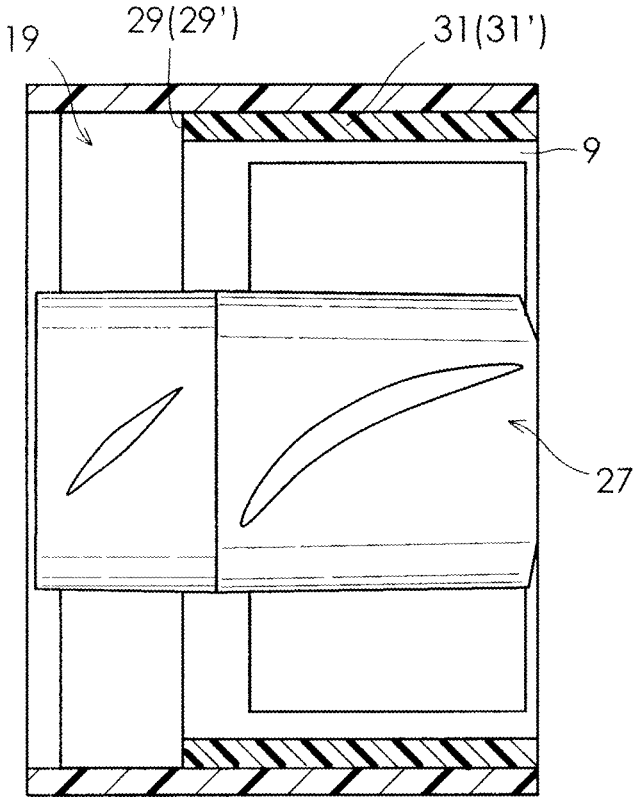
FIG. 7 is a cross-sectional view showing an essential portion of still another embodiment of the present invention.
Figure 8:
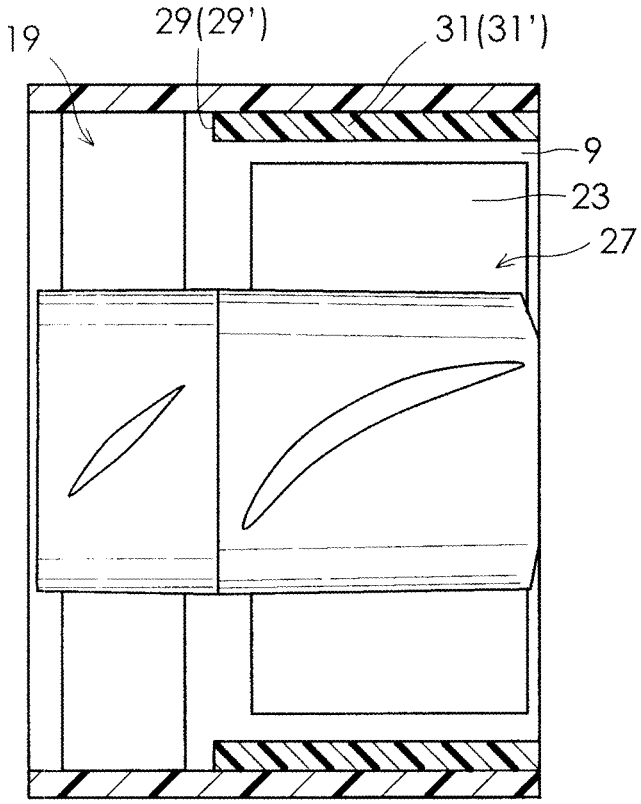
FIG. 8 is a cross-sectional view showing an essential portion of yet another embodiment of the present invention.

The position and length of the one or more ribs 31, 31' for forming the one or more projecting surfaces 29, 29' for generating turbulent flow, as viewed in the axial direction, may also arbitrarily be determined. While the one or more ribs 31, 31' having formed the one or more projecting surfaces 29, 29' for generating turbulent flow are disposed in proximity to the middle stationary portion 19 in the above embodiment, the one or more ribs 31, 31' may be formed such that the one or more projecting surfaces 29, 29' for generating turbulent flow are located at a position away from the middle stationary portion 19 to the side of the discharge port 7 as shown in FIG. 6. In the above embodiment, the length of the one or more ribs 31, 31' as measured in the axial direction is so short as not to face the rear blades 23 of the rear impeller 27 in the radial direction. The length of the one or more ribs 31, 31' as measured in the axial direction may be determined such that the one or more ribs 31, 31' generally face the rear blades 23 of the rear impeller 27 in the radial direction as shown in FIGS. 7 and 8. In the embodiment of FIG. 7, the one or more projecting surfaces 29, 29' for generating turbulent flow are provided in proximity to the middle stationary portion 19 as in the embodiment of FIGS. 1 and 2. In the embodiment of FIG. 8, the one or more projecting surfaces 29, 29' for generating turbulent flow are provided away from the middle stationary portion 19 as in the embodiment of FIG. 6. If the one or more ribs 31, 31' extend toward the discharge port 7 to generally face the rear impeller 27 in the radial direction as in the embodiments of FIGS. 7 and 8, not only the casing 3 can be reinforced, but also the distance between the rear blades 23 of the rear impeller 27 and the inner wall portion 4 of the casing 3 can be reduced, thereby enhancing the static pressure.

While the one or more projecting surfaces 29, 29' for generating turbulent flow extend in the direction orthogonal to the axial line X in the above embodiments, the one or more projecting surfaces 29, 29' for generating turbulent flow do not necessarily extend in the direction orthogonal to the axial line X, and may be inclined, curved, or stepped. Thus, the projecting surfaces 29,29' may arbitrarily be shaped as long as a required turbulent flow can be generated.

While the middle stationary portion 19 includes the stationary blades 17 in the above embodiments, it is a matter of course that the middle stationary portion 19 may include a plurality of struts that support the motors but do not function as stationary blades in place of the stationary blades 17.

According to the present invention, providing one or more projecting surfaces for generating turbulent flow may prevent occurrence of flow separation of a fluid from the surfaces of rear blades. Thus, a novel noise-reducing structure is proposed herein.

While certain features of the invention have been described with reference to example embodiments, the description is not intended to be construed in a limiting sense. Various modifications of the example embodiments, as well as other embodiments of the invention, which are apparent to persons skilled in the art to which the invention pertains, are deemed to lie within the spirit and scope of the invention.

What is claimed is:

1. A counter-rotating axial flow fan comprising:

a casing including an air channel having a suction port on one side in an axial direction and a discharge port on the other side in the axial direction;

a front impeller including a plurality of front blades and configured to rotate in the air channel in a first direction;

a rear impeller including a plurality of rear blades and configured to rotate in the air channel in a second direction, said second direction being opposite to said first direction; and a middle stationary portion formed by a plurality of stationary blades or a plurality of struts disposed to be stationary between the front impeller and the rear impeller in the air channel, wherein one or more ribs are formed on the inner wall portion at a position displaced downstream from the middle stationary portion toward a side of the rear impeller, the ribs extending radially inwardly of the inner wall portion, extending toward the discharge port to generally face the rear impeller in a radial direction, and extending continuously or at intervals in the circumferential direction, and one or more surfaces of the one or more ribs facing the front impeller form one or more projecting surfaces for generating turbulent flow and are shaped and sized to prevent occurrence of flow separation of a fluid from surfaces of the rear blades at a target operating point.

* * * * *

UNITED STATES PATENT AND TRADEMARK OFFICE

CERTIFICATE OF CORRECTION

PATENT NO. : 8,807,919 B2
APPLICATION NO. : 12/967196
DATED : August 19, 2014
INVENTOR(S) : Kato et al.

It is certified that error appears in the above-identified patent and that said Letters Patent is hereby corrected as shown below:

On the title page, Item [75], Inventors, Line 4, delete "Akihiro Otsuka, Sr." and insert --Akihiro Otsuka--.

Signed and Sealed this
Eleventh Day of November, 2014

Michelle K. Lee

Michelle K. Lee
*Deputy Director of the United States Patent and Trademark Office*